United States Patent [19]

Hirabayashi et al.

[11] Patent Number: 4,531,853

[45] Date of Patent: Jul. 30, 1985

[54] WRITING INSTRUMENT WITH A METAL WIRE POINT

[75] Inventors: Masao Hirabayashi, Kawagoe; Takeshi Mizutani, Kuwana, both of Japan

[73] Assignee: Shachihata Industry Co., Ltd., Japan

[21] Appl. No.: 437,624

[22] Filed: Oct. 29, 1982

[30] Foreign Application Priority Data

Nov. 2, 1981 [JP] Japan ..... 56-176244

[51] Int. Cl.[3] ..... B43K 1/10

[52] U.S. Cl. ..... 401/265; 401/198; 401/199; 401/292

[58] Field of Search ..... 401/292, 265, 198, 199, 401/196

[56] References Cited

U.S. PATENT DOCUMENTS

| | | | |
|---|---|---|---|
| 3,306,267 | 2/1967 | Matsumoto | 401/292 X |
| 3,338,216 | 8/1967 | Roller, Sr. . | |
| 3,361,516 | 1/1968 | Rigondaud | 401/292 |
| 3,399,021 | 8/1968 | Matsumoto | 401/199 |
| 3,510,934 | 5/1970 | Koelichen | 401/198 X |

FOREIGN PATENT DOCUMENTS

| | | | |
|---|---|---|---|
| 1561841 | 4/1970 | Fed. Rep. of Germany | 401/265 |
| 3303 | 4/1953 | Japan . | |
| 11723 | 4/1970 | Japan . | |
| 761301 | 9/1980 | U.S.S.R. | 401/292 |

*Primary Examiner*—Steven A. Bratlie

*Attorney, Agent, or Firm*—Brumbaugh, Graves, Donohue & Raymond

[57] ABSTRACT

A writing instrument has a metal writing point formed by a bundle of fine metal wires, which at one end portion of the bundle are laterally compressed and held adjacent to each other with capillary passages between them. A substantially hemispherical tip is formed at the end surface of the end portion and a substantial part of the remainder of the bundle has a longitudinally extending hollow space at the center thereof. A long permeable ink feeding core is inserted into a hollow space for feeding ink to the passages in the tip and the bundle is encased in a cylinder which may be incorporated in a pen having an ink cartridge from which ink is supplied to the core. The compressed wires are durable and can be provided with a smooth hemispherical surface which moves smoothly over the paper. The passages and the core ensure a steady supply of ink. The writing point also enables sufficient pressure to be applied when writing for making copies with carbon or copy paper.

11 Claims, 17 Drawing Figures

WRITING INSTRUMENT WITH A METAL WIRE POINT

This invention relates to a writing instrument with a pen, more particularly to a writing instrument with a metal point pen having a point constructed of a cluster of a plurality of fine metal wires.

Heretofore, the point or nib of a pen was constructed of synthetic fibre; felt; synthetic resin; or ceramic material.

The point of the pen constructed by synthetic fibre or synthetic resin was disclosed in Japanese Patent Publication No. 4461/1957 which was published on July 4, 1957 and issued to T. Funabashi and U.S. Pat. No. 3,338,216 which was issued to Frank W. Roller Sr. on Aug. 29, 1967. The point of the pen was constructed of a cluster exclusively of a plurality of fine metal wires placed adjacent to each other. However, the pen point constructed of synthetic fibre, felt or synthetic resin has softness so that the writing thereof is easily done and has low abrasion-resistance; in continuous use the point is easily broken and becomes thick and consequently it has the defect of not being able to write smoothly. Also, a pen with this type of point is not suitable for multiple copying which requires high writing pressure.

A point constructed of ceramic material has good abrasion-resistance. However, it lacks softness so that the point may be broken. Also, since it does not have smooth contact with the paper, it has the defect of not being able to write smoothly.

The metal point pen mentioned above has good abrasion-resistance. However, in the case of a point constructed exclusively of a cluster of a plurality of fine metal wires, it is necessary that the point be used approximately at a right angle to the paper. Also, a point constructed of sintered metal particles does not have smooth contact with the paper annd consequently has the defect of not being able to write neatly.

The invention of Japanese Patent Publication No. 11723/1970 published on Apr. 28, 1970 and patented to S. Tsujimoto discloses a metal point pen constructed exclusively of a cluster of a plurality of fine metal wires placed adjacent to each other. Through etching the surface of each of these metal wires is made minutely uneven. The metal wires are then bound together, and one end of the bundle is then ground, first mechanically to form a hemispherical shape, and then electrolytically to eliminate burr due to the mechanical grinding in order to acquire a smooth hemispherical shape at its end surface.

With this type of metal point pen, however, the flow of ink is not smooth and is often disrupted when in use. This is because the metal wires are placed adjacent to each other with extremely small openings between themselves so as to prevent a sufficient flow of ink. Also, due to a lot of unevennesses existing on the hemispherical end surface, this type of point has the defect of not having smooth contact with the paper.

The object of the present invention is to provide a writing instrument with a metal point pen without the above-mentioned defects, more particularly to provide a metal point pen that is good at any writing angle, has high abrasion resistance, is suitable for multiple copying, ensures continuous flow of ink to the metal point, and ensures that the metal point has smooth contact with the paper.

According to this invention, a writing instrument is provided with a metal point pen comprising: a cluster of a plurality of fine metal wires placed adjacent to each other in a circumferential shape, the fine metal wires at the end portion of said cluster being compressed and made adjacent to each other to provide capillary paths between them leading to an end face which has an almost hemispherical shape, the greater part of the rest of said cluster having a longitudinal hollow space at the inner center thereof; and a long core adapted to lead ink inserted into said hollow space.

According to another aspect of the present invention, a metal point pen is provided in which the end portion of said core adapted to lead ink is compressed in its diameter and is extended close to the tip of said cluster of fine metal wires placed adjacent to each other.

Other objects and advantages of the present invention will become apparent from the following detailed explanation when read in connection with the accompanying drawings wherein.

Figure 1:
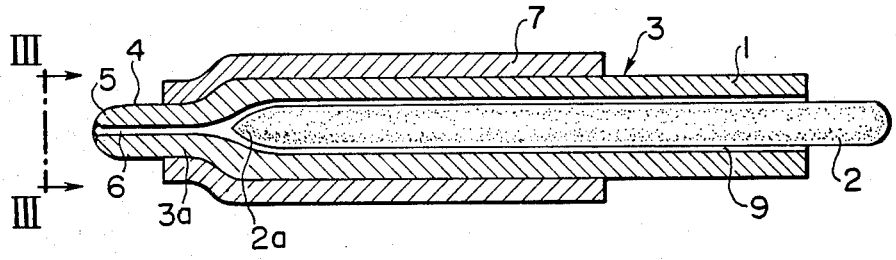
FIG. 1 is a longitudinal section of the main part of the metal point pen in accordance with the present invention.
Figure 2:
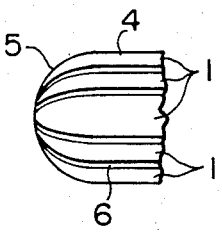
FIG. 2 is a side view of a part of the metal point of the pen of FIG. 1.
Figure 3:
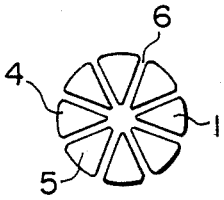
FIG. 3 is a front view of a part of the point as seen in the direction of III—III arrows in FIG. 1.

In an embodiment in accordance with the present invention, as shown in FIG. 1 to FIG. 3, a cluster 3 of a plurality of fine metal wires 1 are placed adjacent to each other in a circumferential shape inside a hollow cylinder 7. In this particular embodiment, 8 fine wires are clustered. The number of fine wires used should be more than 4, preferably 5–10. The end portion 3*a* only of the cluster 3 of fine metal wires 1 is compressed, forcing the metal wires to be adjacent to each other, and the end surface 5 of the end portion 3*a* is made to form an almost hemispherical shape. The greater part of said cluster 3 has at its inner center a longitudinal hollow into which a long ink leading core 2 is inserted. Thus, the fine metal wires 1 are positioned adjacent to each other and form capillary paths between themselves, consequently forming a pen point 4 of a smaller diameter.

Figure 4:
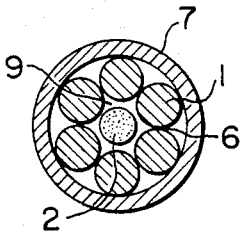
FIG. 4 is a cross-sectional view of another embodiment in accordance with the present invention.

In another embodiment shown in FIG. 4 the number of fine metal wires 1 used is 6.

Figure 5:
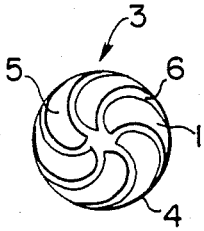
FIG. 5 is a front view of the point of still another embodiment in accordance with the present invention.

In still another embodiment shown in FIG. 5 the pen point is structured of a cluster 3 of fine metal wires that were twist-processed.

Figure 6:
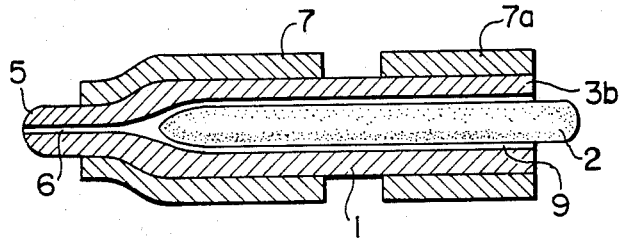
FIG. 6 is a vertical section of another embodiment of the pen of FIG. 1.
Figure 7:
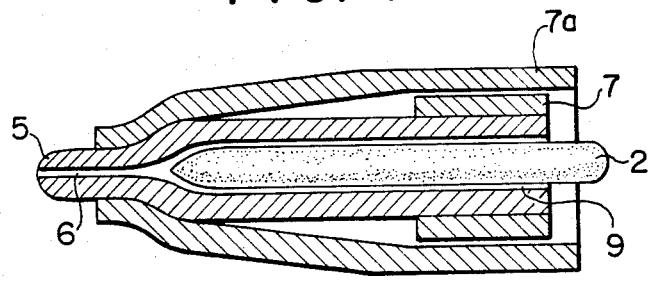
FIG. 7 is a vertical section of still another embodiment of the pen of FIG. 1.

In still another embodiment shown in FIG. 6 and FIG. 7, the hollow cylinder consists of two parts, 7 and *7a*.

Figure 8:
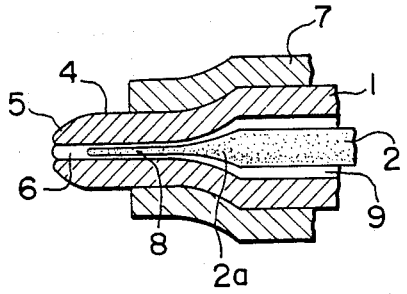
FIG. 8 is a partial vertical section of still another embodiment in accordance with the present invention.

In still another embodiment shown in FIG. 8, the end portion *2a* of the ink leading core 2 is compressed and is reduced in its diameter together with the cluster of fine metal wires. The tip of the end portion *2a* with a reduced diameter is extended close to the tip of the pen point 4. The extended porton is indicated by 8.

Figure 9:
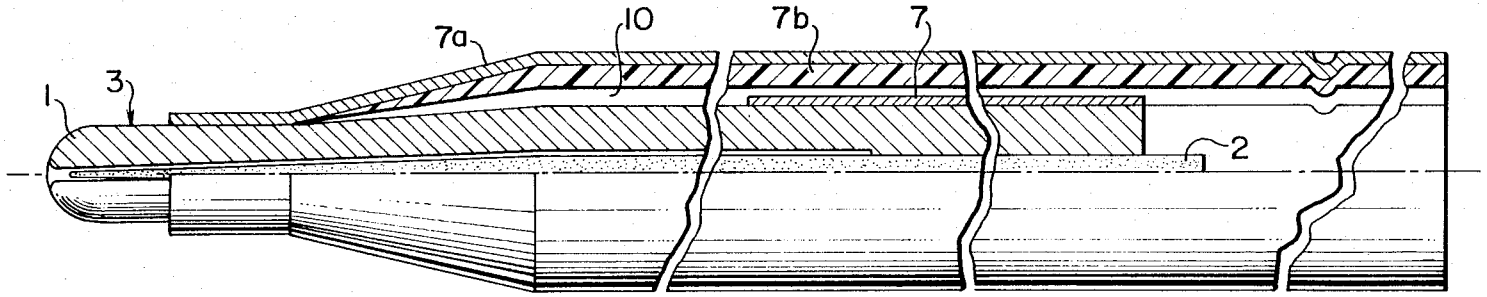
FIG. 9 is a partial vertical section of other embodiment in accordance with the present invention.

FIG. 9 shows still another embodiment in accordance with the present invention. Here, the hollow cylinder consist of an outermost cylinder *7a*, an intermediate cylinder *7b* which is in contact with the inner periphery of the outermost cylinder *7a*, and finally an inner cylinder 7 adapted to contain and fix the cluster 3 of fine metal wires. Between the intermediate cylinder *7b* and inner cylinder 7 there is a circumferential opening 10.

Figure 10:
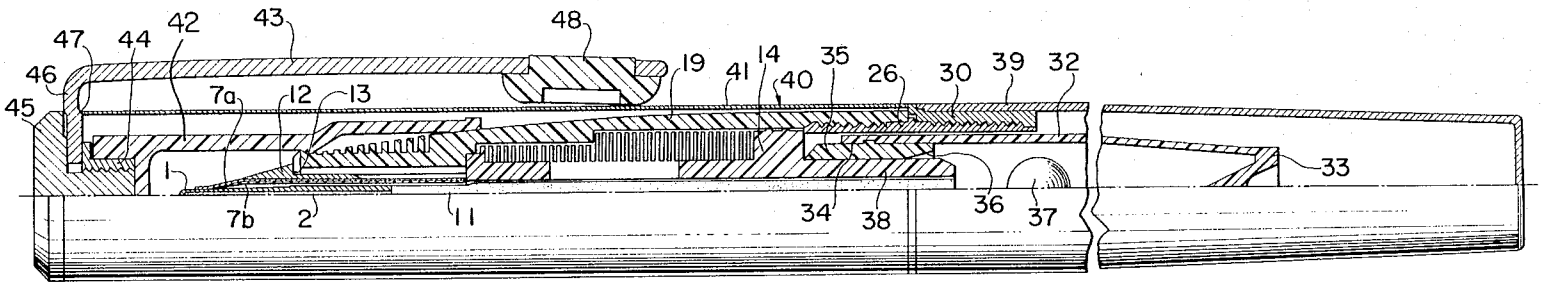
FIG. 10 is a partial vertical section of an embodiment of a writing instrument with the metal point pen in accordance with the present invention.
Figure 17:
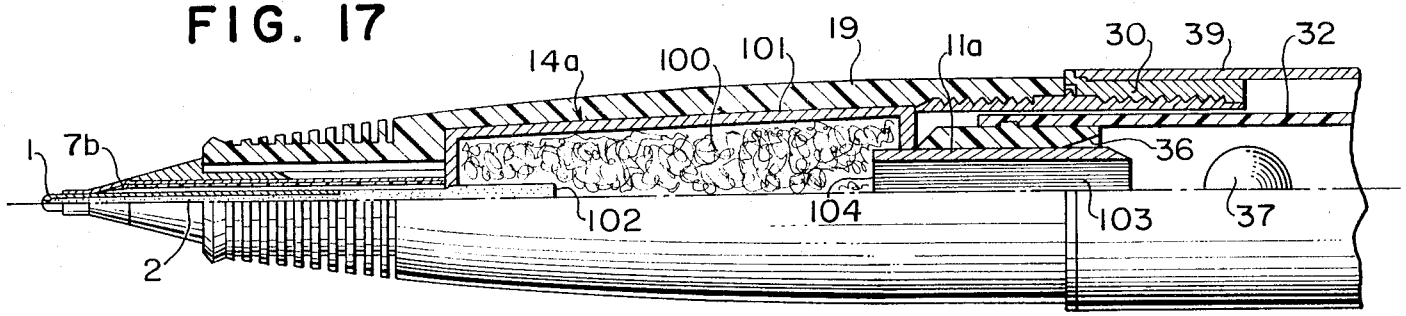
FIG. 17 is a longitudinal sectional view of a further embodiment of an ink adjusting member.

In still another embodiment shown in FIG. 10, a connecting core 11 for leading the ink is connected to the tail end of the ink leading core 2. The connecting core 11 for ink-introducing may be of synthetic fiber which is set by synthetic resin and may be of a pipe made from synthetic material having a capillary path 103 in the center thereof as shown in FIG. 17. To the outer periphery of the outermost cylinder *7a* a hollow pen point holder 12 is fixed. The pen point holder 12 has a shoulder 13 on its intermediate circumference. An ink adjusting member 14 is connected to the tail end of the outermost cylinder *7a*.

Figure 12:
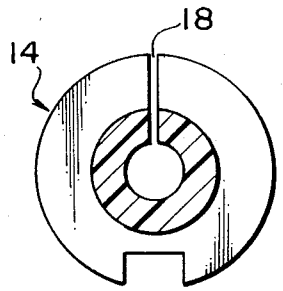
FIG. 12 is a cross section of the member of FIG. 11.
Figure 11:
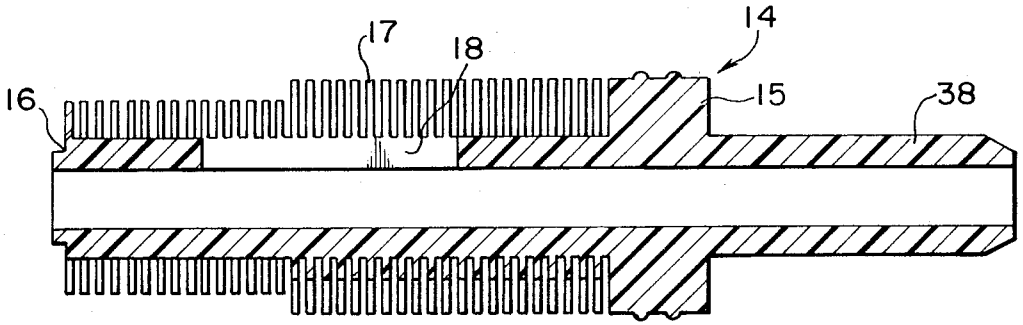
FIG. 11 is a vertical section of an ink adjusting member of the instrument of FIG. 10.

As shown in detail in FIG. 11 and FIG. 12, the ink adjusting member 14 is a cylindrical form with a bore to fit the outside diameter of the connecting core 11 for leading the ink, and is provided with an integral shoulder 15 approximately at its intermediate outer periphery. On its outer periphery between the shoulder 15 and the end portion 16 of the pen point side, the ink adjusting member 14 has a plurality of annular fins 17 projecting from thereof in a unified manner. Furthermore, the member 14 has a slit 18 on one side at an intermediate area between the shouder 15 and the end portion 16, the slit 18 continuing through to the opening between the interior of the cylinder of the member 14 and the fins 17.

An ink adjusting member *14a* shown in FIG. 17 may be used in lieu of the ink-adjusting member 14 shown in FIG. 11.

The ink adjusting member *14a* includes a cylindrical chamber 101 which is filled with synthetic fibre 100 or the like.

A rear end portion 102 of the ink adjusting core 2 is tightly inserted into the interior of the cylindrical chamber 101 and is contacted with synthetic fibres 100 in the cylindrical chamber 101.

A connecting core *11a* is tightly inserted into the interior of the cylindrical chamber 101 from the side of the cartridge body 32 and a leading end 104 of the core *11a* is contacted with the synthetic fibre 100.

Ink is transferred from the cartidge body 32 to the ink-adjusting member *14a* through the capillary path 103 of the connecting core *11a* and transferred to the leading portion of the pen point through the core *11a*.

Figure 13:
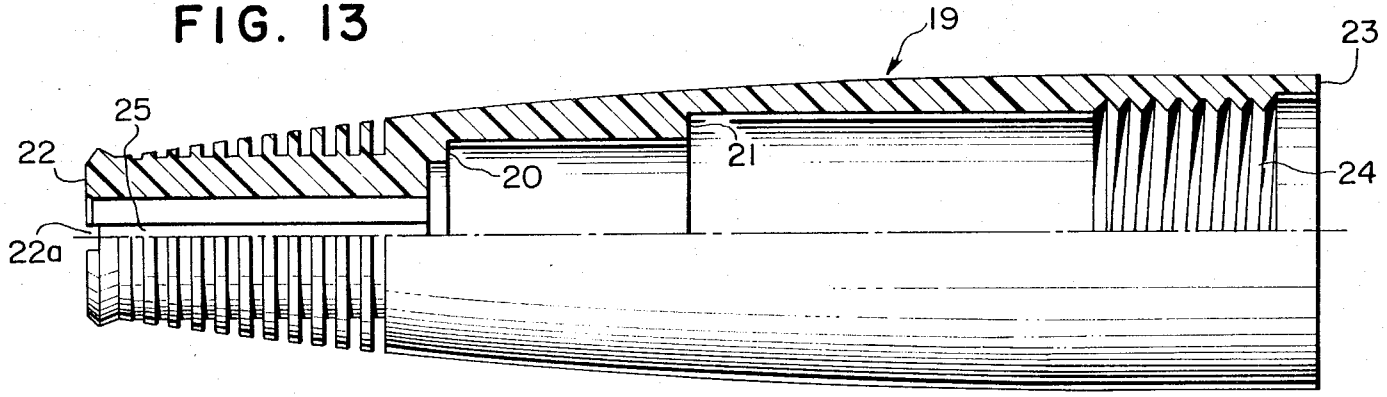
FIG. 13 is a partial vertical section of a part of a penholder.
Figure 14:
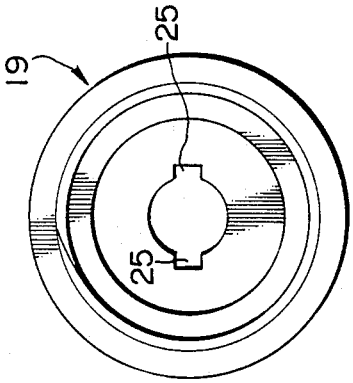
FIG. 14 is a front view of an end surface of a penholder.

On the outer periphery of the shoulder 13 of the pen point holder 12 and the ink adjusting member 14, a pen-holder 19 is arranged. As shown in FIG. 13, the penholder 19 is almost cylindrical in shape and the inner periphery thereof has two shoulders 20 and 21; the bore between the end portion 22 of the penholder 19 and the shoulder 20 is slightly smaller than that between the shoulder 20 and shoulder 21. Further, the bore between the shoulder 21 and the tail end 23 of the penholder 19 is slightly larger than the above-mentioned bore between the two shoulders. The inner periphery of the penholder has a screw 24 near the tail end 23.

The bore between the end portion 2 of the penholder 19 and the shoulder 20 has a pair of longitudinal grooves 25. Each longitudinal groove 25 communicates with a notch *22a* in the leading end 22 thereof and serves to act as an air-communicating channel. The portion between the end portion 22 and the shoulder 20 lies between the shoulder 13 of the pen point holder 12 and the end portion 16 of the ink adjusting member 14, and the portion between the shoulder 20 and the tail end 23 surrounds the outer periphery of the ink adjusting member.

Figure 15:
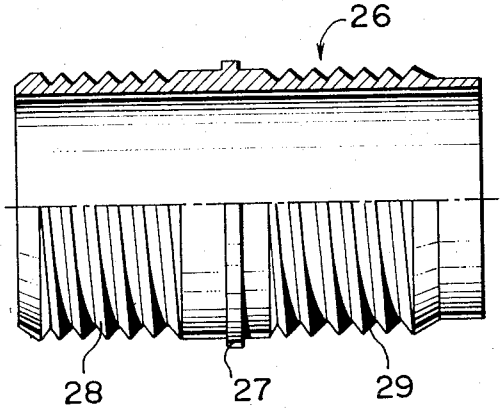
FIG. 15 is a partial vertical section of a fixing screw member.

A fixing screw member 26 shown in FIG. 15 is almost cylindrical in shape and has a projection 27 approximately at the center of the outer periphery thereof and has screws 28 and 29 on the outer periphery thereof, at the front and back respectively of the projection 27.

The screw 28 matches a screw thread 24 on the penholder 19.

Figure 16:
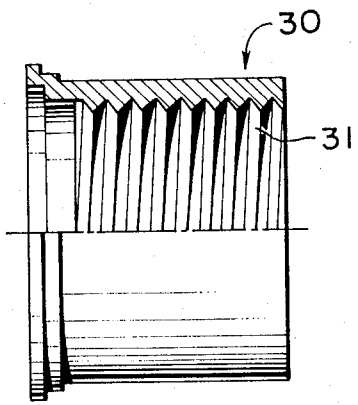
FIG. 16 is a partial vertical section of a connecting screw member.

A connecting screw member 30 shown in FIG. 16 is almost cylindrical in shape and has a screw 31 in its inner periphery. The screw 31 matches the screw 29 of the fixing screw member 26.

As shown in FIG. 10, a cartridge body 32 is connected to the back of the ink adjusting member 14.

The cartridge body 32 is almost cylindrical in shape with its tail end 33 closed and its tip open. Inside the opening 34 at the tip, a cartridge tip member 35 is placed. The inner peripherical edge of the tail end or, in other words, the inner end of this member 35 is provided with a cone-shaped portion 36 into which a metal ball 37 normally is fixed, consequently sealing the ink contained in the cartridge body 32.

When the cylindrical portion 38 of the back part of the ink adjusting member 14 is inserted into the cartridge tip member 35, the metal ball 37 is released from the cone-shaped portion 36 and is moved into the ink contained in the cartridge body 32. Thus, the ink is led to the ink leading core 2 via the connecting core 11 for conducting the ink. In this case, when the core is fully filled, the ink is transferred outwardly through the slit 18 in the ink adjusting member 14 and held in the spaces between the fins 17.

The outer periphery of the connecting screw member 30 is covered with the opening portion on one end of a pen body 39 which is almost cylindrical in shape. The other end of the pen body 39 is closed. Therefore, the cartridge body 32 is covered by the pen body 39.

A cap body 40 consists of an outer cylinder 41, an inner cap 42 which is almost cylindrical in shape, a clip 43, and clip fixing screw members 44 and 45, a bent portion 46 on one end of said clip 43 being fixed to the inner cap 42 by the clip fixing screw members 44 and 45 and also being inserted in a notch 47 on one end of the outer cylinder 41. The inner cap 42 matches the outer periphery of the penholder 19.

The other end of the clip 43 is provided with a terminal 48, the inside of the terminal 48 being in contact with the outer cylinder 41.

In order to form the end portion of the cluster 3 of fine metal wires mechanical process methods such as drawing, swaging and spinning are used. Thus, the pen point is transformed and bound closely together to form its shape. The roughness on the pen point due to the mechanical processing is smoothed out by electrolytic grinding, barrel processing and laser processing and the like. Thus, a pen point 4 as shown in FIG. 2 and FIG. 3 is obtained.

When in use, the ink held in the ink leading core 2 is led finally into the capillary paths 6 at the pen point 4 via the capillary paths 6 between the fine wires leading from the capillary paths 9 between the fine wires and the ink leading core 2.

At the end portion of the fine wires, which is compressed in its diameter, the fine wires are in contact with each other in the form of a flat surface, allowing a uniform supply of ink throughout the spherical end surface 5.

Since its pen point 4 has a smooth spherical shape, the metal point pen of above mentioned structure ensures a smooth supply of ink and consequently smooth writing, and the lines written by this pen are even in their width. Also, the writing angle of the pen to the paper is not restricted nor does the pen scratch the paper.

To ensure the insertion of the ink leading core 2 into the ink holding body, it is possible to cut obliquely the tail end portion **3*b* of the metal wires cluster. It is also possible to cut obliquely both the tail end portion 3*b* and the outer cylinder 7**.

The outside diameter of the fine metal wires 1 is desirably 0.01–1 mm. Below 0.01 mm the pen point is bent and there is a worry that the pen point may scratch the paper. On the other hand, over 1 mm the capillary phenomenon of the ink between the fine lines is small and the necessary capillary path function is not obtainable.

With regard to the number of fine metal wires, in the case where more than 10 wires are used, it is difficult to arrange the fine wires around the ink leading core into a single line or circumferential row as well as to maintain the arrangement. Also, since there are more openings between the fine wires, smooth contact of the pen on the paper becomes difficult.

It is possible to contain the plurality of fine wires by use of a hollow cylinder only. An ink leading core consisting of synthetic resin or the like may be temporarily positioned, a plurality of fine lines are positioned around the ink leading core, and the core and the fine wires are positioned in a hollow cylinder and heated at 1000°–1300° C. so that they are sintered together after which the wires are laterailly compressed together at one end to form a writing tip. The ink leading core 2 is inserted into a cell or space between the other ends of the wires where they are not compressed.

Desirable materials for the fine wires are abrasion-resistant metals such as carbon steel and stainless steel.

Desirable materials for the ink leading core are synthetic fibre, felt, synthetic resin and the like which are constructed into fine cylinders.

The pen point constructed of fine metal wires in accordance with the present invention is hard and elastic, therefore, the point hardly separates even when over and above normal writing pressure is applied to. In other words, the pen in accordance with the present invention is able to absorb excessive writing pressure.

As an embodiment in accordance with the present invention, a metal point pen was produced in the following manner: 6 fine wires of SUS 304 stainless steel (JIS) (including less than 0.08% C, less than 1.00% Si, less than 2.00% of Mn, less than 0.040% P, less than 0.030% S, 8.00–10.50% Ni, 18.00–20.00% Cr) with an outside diameter of 0.35 mm was inserted into a hollow cylinder of SUS 316 (JIS) (including less than 0.08% C, less than 1.00% Si, less than 2.00% Mn, less than 0.040% P, less than 0.030% S, 10.00–14.00% Ni, 16.00–18.00% Cr, 2.00–3.00% Mo) stainless steel with a bore of 1.1 mm and an outside diameter of 1.3 mm, which was then closely bound and fixed together by the drawing method. Then, the 1.4 mm part of the end portion of the fine wires was compressed to 0.8 mm in its diameter and the tip was ground to form a hemispherical shape, the end portion of the cylinder being eliminated through cutting. Finally, the roughness on the hemispherical surface was smoothed out by electrolytic grinding.

Next, the other end of the metal point had an ink leading core constructed of polyvinyl acetal resin material inserted into it. The core was in the form of a fine cylinder which was star-shaped in its cross section, which was then connected to a shaft having an ink holding body. The pen thus produced was put through writing performance tests together with various kinds of pens currently on the market. The tests were conducted by using aqueous ink.

The tests were conducted under the following conditions: Writing speed—10 cm/sec.; Writing paper of fine quality—60 gr/m$^2$; Angle of the pen toward the paper—75°; Load—5 g for a plastic material pen point and a ceramic material pen point currently on the market, 50 g for a ball point pen currently on the market, and 25 g for the point pen in accordance with the present invention.

TABLE 1

| Type of pen | Writing length before ink exhaustion | Degree of abrasion |
|---|---|---|
| Plastic pen | 700 m | The abrasion loss of the pen point is 0.5–0.6μ. The pen point becomes pulpy and cracked. |
| Ceramic pen | 500 m | The coating on the ceramic pen is worn off. The paper dust clogs the pen. |
| Ball point pen | 800 m | The abrasion loss of the ball and the seat thereof is 40–50μ, so that the ink leak, the ball can fall out and the paper dust clogs in the pen. |
| Metal point pen of the present invention | 20,000 m | The abrasion loss of the pen is 30μ. |

As is obvious from the test results of Table 1, the abrasion resistance of the metal point pen in accordance with the present invention is significantly superior to various pens currently on the market.

We claim:

1. A writing instrument, comprising: a metal writing point formed by several fine metal wires arranged in a single circumferential row about a central axis to define a centrally-located longitudinal hollow space extending along a substantial portion of the length of said wires, said hollow space being adapted to receive at least partially an ink feeding core, said several wires at one end portion thereof having a substantially hemispherical end face which forms a metal writing tip and being inwardly compressed towards said central axis to form flattened capillary paths between circumferentially adjacent wires which lead to said end face.

2. A writing instrument according to claim 1 wherein from the number of said several fine wires employed is in the range of five to about ten.

3. A writing instrument according to claim 2 wherein said several fine wires are sintered.

4. A writing instrument according to claim 2 wherein said several fine wires are comprised of stainless steel.

5. A writing instrument in accordance with claim 1 or claim 2 and further comprising a hollow cylinder holding said several fine wires with said one end portion of the wires projecting out of one end of the hollow cylinder and a tail end of the core projecting from the other end of the cylinder, a penholder covering the outer periphery of said hollow cylinder, a connecting core for feeding ink connected to the tail end of the ink feeding core, an ink adjusting member surrounding the outer periphery of the connecting core, an ink containing cartridge connected to the ink adjusting member and to the connecting core for supplying ink, a pen body connected to the penholder and surrounding the outer periphery of the cartridge, and a cap adapted to cover the penholder.

6. A writing instrument according to claim 2 wherein said longitudinal hollow space extends along the entire length of said wires.

7. A writing instrument according to claim 1, claim 2 or claim 6 wherein said several fine wires at least at said one end portion thereof are twist-processed.

8. A writing instrument according to claim 1 wherein the number of fine wires employed is eight.

9. A writing instrument according to claim 1 wherein the number of fine wires employed is six.

10. A writing instrument according to claim 1 and further comprising a hollow cylinder holding at least said one end portion of said several fine metal wires together in said circumferential row arrangement.

11. A writing instrument according to claim 1 wherein said fine metal wires each have an outside diameter in the range of 0.01 mm to 1 mm.

* * * * *